United States Patent [19]

Shepherd et al.

[11] 4,193,252

[45] Mar. 18, 1980

[54] KNIT-DEKNIT METHOD OF HANDLING YARN TO PRODUCE CARBON OR GRAPHITE YARN

[75] Inventors: Gary D. Shepherd, Redondo Beach; Ramon B. Fernandez, Hawthorne; R. Glenn Kapaun, Huntington Beach; Charles P. Logan, Hawthorne, all of Calif.

[73] Assignee: Hitco, Irvine, Calif.

[21] Appl. No.: 919,850

[22] Filed: Jun. 28, 1978

[51] Int. Cl.[2] ..... D01F 9/12; D04B 19/00; D02G 1/00

[52] U.S. Cl. ..... 57/351; 28/171; 28/218; 57/239; 423/447.1; 423/447.4

[58] Field of Search ..... 57/140 R, 151 R, 351, 57/236, 239, 245, 246; 423/447.1, 447.4, 447.8; 28/171, 218

[56] References Cited

U.S. PATENT DOCUMENTS

| | | | |
|---|---|---|---|
| 3,294,489 | 12/1966 | Millington et al. | 423/447.4 |
| 3,720,984 | 3/1973 | Roberson, Jr. | 28/171 X |
| 3,849,847 | 11/1974 | Corbiere | 28/171 X |
| 4,014,725 | 3/1977 | Schulz | 423/447.1 X |

*Primary Examiner*—John Petrakes
*Attorney, Agent, or Firm*—Fraser and Bogucki

[57] ABSTRACT

In a method of making carbon or graphite yarn, a bundle of single ply precursor yarns is knit into an elongated fabric to facilitate subsequent processing of the yarns. The elongated fabric is pretreated to facilitate carbonization thereof such as by being advanced in the direction of elongation thereof through a cleaning process. Thereafter the yarns remain in the form of the fabric to facilitate processing thereof through at least a carbonization step. The carbonization step may be accomplished by winding the elongated fabric onto skeins to a desired extent and then severing the fabric, following which the skeins are disposed in a carbonizing oven to at least partially carbonize the yarns. Thereafter, the fabric length on each skein may be deknitted, and the resulting bundle of single ply yarns is twisted to form a multi-ply yarn which is then fired to substantially raise the percentage of carbon in the yarns and then graphitized. Alternatively, deknitting of the fabric can be delayed until after the firing step or after the graphitization step so as to facilitate movement of the yarns through these processes also, where some deformation in the yarns is tolerable or desirable.

10 Claims, 7 Drawing Figures

KNIT-DEKNIT METHOD OF HANDLING YARN TO PRODUCE CARBON OR GRAPHITE YARN

BACKGROUND OF THE INVENTION

1. Field of the Invention

The present invention relates to methods of forming carbon or graphite yarn in which carbonizable precursor yarns are pre-treated as necessary and then heated in an inert atmosphere to a temperature sufficient to at least partially carbonize the yarns, with the yarns thereafter being fired, and then graphitized if desired.

2. History of the Prior Art

It is known to form carbon or graphite yarns by running carbonizable precursor yarns of materials such as continuous filament rayon through a process in which the yarns are cleaned such as by a dry cleaning process, then carbonized, then fired, and finally graphitized as desired. Cleaning removes surface finishes from the precursor yarns so that the yarns can be readily carbonized by heating to a carbonizing temperature in an inert atmosphere. The yarns are thereafter fired by heating to a temperature above about 900° C. in an inert atmosphere for a relatively short period of time so as to substantially raise the percentage of carbon in the yarns. An example of such a process is provided by U.S. Pat. No. 3,294,489 of Millington et al, issued Dec. 27, 1966 and commonly assigned with the present application.

In such prior art processes the precursor yarns are typically twisted together to form a multi-ply yarn which is then processed in batches. The multi-ply yarn is wrapped on skeins and periodically severed, following which the skeins are placed in a dry cleaning tank for removal of weaving lubricants and thereafter in a carbonization oven. There are several problems with this technique including the fact that the yarn is expensive to make because of the labor involved in wrapping the skeins, severing the yarn after formation of each 1–2 lb. skein and loading the individual small skeins into batch cleaning equipment. Moreover, there is a persistent tangling problem as the yarns are wound onto and off of the skeins, resulting in substantial yield losses due to tangled yarn which cannot be used. The final yarn product itself tends to be of poor or nonuniform quality due to the limitations imposed by handling of the skeins during processing. Because the yarns must be cut after they are wrapped on the skeins, the yarn is typically cleaned, carbonized, fired and graphitized in 1–2 lb. lots. After carbonization and firing this reduces the yarn lots to on the order of $\frac{1}{4}$–$\frac{1}{2}$ lb., requiring that the resulting yarn produced by the process have frequent knots along the length thereof as the small $\frac{1}{4}$–$\frac{1}{2}$ lb. lots of yarn are knotted together to form the yarn.

Accordingly, it would be desirable to be able to process precursor yarns in a highly efficient and effective manner so as to produce carbon or graphite yarn having relatively low cost and with little wastage, and having generally uniform high quality. Such process should ideally lend itself to the rapid and continuous processing of the yarns in large quantities, and should permit the yarn to be processed in relatively long lengths so as to reduce the frequency of knotted joints in the resulting yarn product.

Accordingly, it is an object of the invention to provide an improved, more efficient process for forming carbon or graphite yarn from precursor yarns.

It is a further object of the invention to provide a process for making carbon or graphite yarn in which the yarns can be handled efficiently in large quantities and processed rapidly and on a generally continuous basis to produce yarn of relatively high quality and uniformity and at the same time relatively low cost.

It is a still further object of the invention to provide a process permitting yarn to be processed in substantial lengths to produce an end yarn product having relatively few knotted joints.

BRIEF SUMMARY OF THE INVENTION

Processes in accordance with the invention for making carbon or graphite yarn from precursor yarns form the yarns into an elongated fabric for ease and efficiency of handling and processing during the carbonizing step as well as the prior cleaning step or other pre-carbonization processing often required. The elongated fabric is formed from a bundle of one or more yarns at the outset such as by knitting, following which the fabric may be run through dry cleaning equipment to remove surface finishes or othewise subjected to pre-carbonization treatment as desired. Thereafter, the scoured fabric may be wrapped onto individual skeins and periodically severed, with the skeins then being placed in a carbonization oven to at least partially carbonize the yarns. The fabric is eventually disassembled into the yarn bundle, with the individual single ply yarns thereafter being twisted to form a multi-ply yarn.

In one process according to the invention disassembly of the fabric is accomplished following carbonization and prior to firing and graphitization of the yarn. In an alternative process the fabric is disassembled after firing and prior to graphitization. In yet another process according to the invention, the fabric is disassembled only after firing and graphitization.

In one example of a process according to the invention plural single ply precursor yarns drawn from individual spools are formed into a single bundle which is then fed into a knitting machine to knit a fabric in the form of a continuous hollow cylindrical sock. The knitted fabric is collapsed on itself to form a flat fabric and, if cleaning of the fabric is necessary, the fabric is advanced through dry cleaning apparatus by joining the leading end of the fabric to the trailing end of a length of starter material already advanced at least part way through the dry cleaning apparatus. The knitted fabric is then pulled through the dry cleaning apparatus following which the fabric is wrapped around individual skeins and severed. The skeins are placed in a carbonizing oven where the yarns are at least partially carbonized, following which the yarns can be fired and graphitized in the knitted fabric form or in individual yarn form depending on whether the fabric is deknitted prior to firing, prior to graphitization or following graphitization. Deknitting of the fabric produces the bundle of single ply yarns which are then twisted to form a multi-ply yarn. As an alternative, the single ply yarns can be twisted to the desired ply prior to knitting, in which even deknitting produces a multi-ply yarn.

BRIEF DESCRIPTION OF THE DRAWINGS

The foregoing and other objects, features and advantages of the invention will be apparent from the following more particular description of preferred embodiments of the invention, as illustrated in the accompanying drawings, in which.

DETAILED DESCRIPTION

Figure 1:
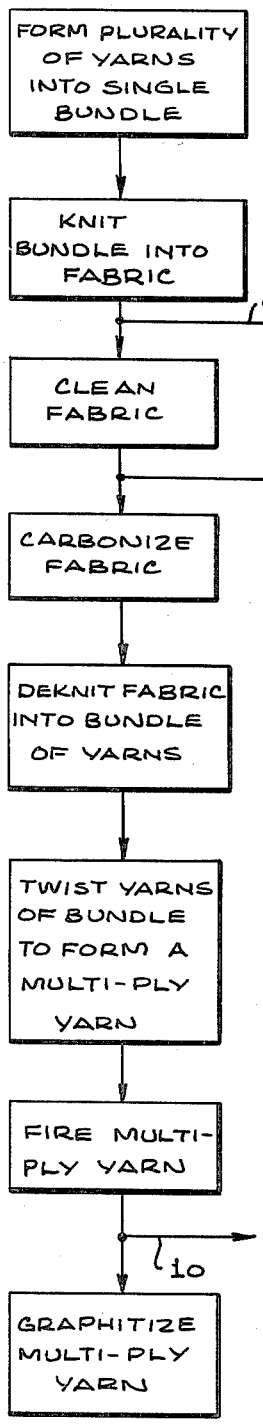
FIG. 1 is a block diagram of the successive steps in a preferred method of making carbon or graphite yarn according to the invention.

FIG. 1 depicts the successive steps in a preferred method of making carbon or graphite yarn in accordance with the invention. In the first step a plurality of single ply precursor yarns of rayon or other carbonizable material are formed into a single yarn bundle. Alternatively, the bundle can be formed from one single ply yarn or from a plurality of single ply yarns twisted together to form one multi-ply yarn. The bundle is then used to assembly an elongated fabric, such as by knitting, following which the formed fabric is subjected to any necessary pre-carbonization treatments such as dry cleaning. Dry cleaning, scouring or other cleaning may be necessary as where the yarns have a sizing or other surface finish that must be removed to maximize the physical properties of the finished product. Where finishes are not present on the yarns, the cleaning step may be omitted as shown by the leg 8 in FIG. 1. Following the pre-carbonization treatments, the elongated fabric is wound onto each of a plurality of skeins and severed, with each skein then being placed in a carbonizing oven. The sections of fabric are heated in an inert atmosphere to a temperature sufficient to at least partly carbonize the yarns, whereupon the fabric is deknitted or otherwise disassembled by pulling on a loose or separated end of the bundle of yarns. Following deknitting of the fabric the individual single ply yarns are twisted around each other to form a multi-ply yarn. A plurality of the multi-ply yarns are then drawn through a firing furnace where they are briefly heated in an inert atmosphere to a temperature sufficient to substantially increase the percentage of carbon in the yarns. Thereafter, the multi-ply yarns are run through an adjacent graphitization furnace where they are briefly heated in an inert atmosphere to a temperature sufficient to substantially graphitize the yarns, thereby producing the desired graphite yarns. The desired graphite yarns. In the event carbon yarns are desired the graphitization step is omitted as shown by an alternate leg 10 in FIG. 1.

As the carbonized singly ply yarns are twisted together to form a multi-ply yarn, the multi-ply yarn is typically wound onto a spool for storage prior to firing and graphitization. The multi-ply yarn is severed following winding onto each spool, thereby forming 1–1½ lb. lengths after firing and graphitization for the twister used in this example. The resulting lengths of finished multi-ply yarn must then be knotted together if a continuous yarn of greater length is to be formed. While this is far superior to prior art processes in which the lengths of yarn wound onto skeins reduce to ¼–½ lb. lengths which must be knotted together, the frequency of knots in the finished yarn can be even further reduced by twisting the bundle of single ply yarns to form the multi-ply yarn prior to knitting with the step of twisting after carbonization thereby being eliminated. Thereafter the multi-ply yarn can be knit, deknit and otherwise processed in continuous lengths of as much as 100 lbs. or more.

Figure 2:
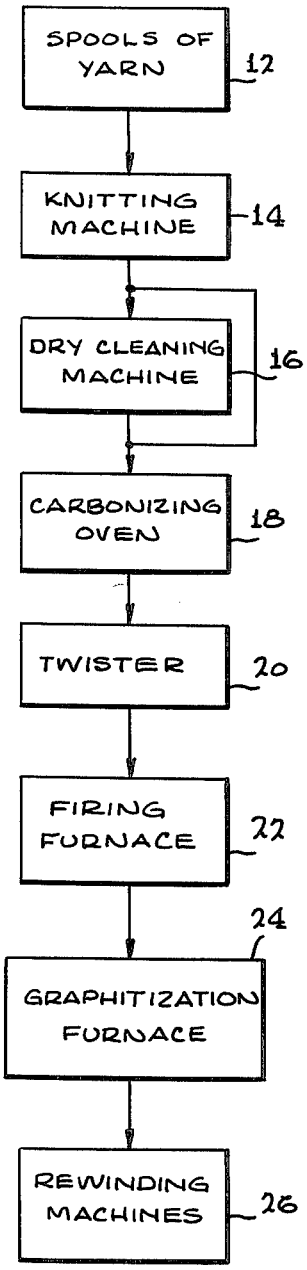
FIG. 2 is a block diagram of the basic apparatus used in carrying out the method of FIG. 1.

FIG. 2 depicts one example of a combination of equipment which can be used to carry out the process of FIG. 1. In FIG. 2 the various precursor yarns which have been previously wound onto individual spools 12 are simultaneously unwound from the spools 12 so as to form a single bundle of yarns as they enter a knitting machine 14. The knitting machine 14 knits the single bundle into an elongated fabric which is then fed into and through a dry cleaning machine 16 to clean the yarns. Next the elongated fabric is wrapped around individual skeins and severed with the skeins being placed in a carbonizing oven 18 to at least partially carbonize the yarns. Following carbonization the elongated fabric is disassembled or deknitted by locating at least one loose end of the yarn bundle and pulling the various loops out of the knitted fabric in succession as the yarn bundle is fed into a twister 20. The twister 20 twists the individual yarns on one another, forming a multi-ply yarn. One or more of the multi-ply yarns are drawn through a firing furnace 22 which substantially increases the percentage of carbon in the yarns prior to drawing of the multi-ply yarns through a graphitization furnace 24. Following graphitization in the furnace 24 the multi-ply yarn is fed to rewinding machines 26 where the yarn is wound onto spools, rollers or other arrangements for winding and storing the yarn.

Figure 3:
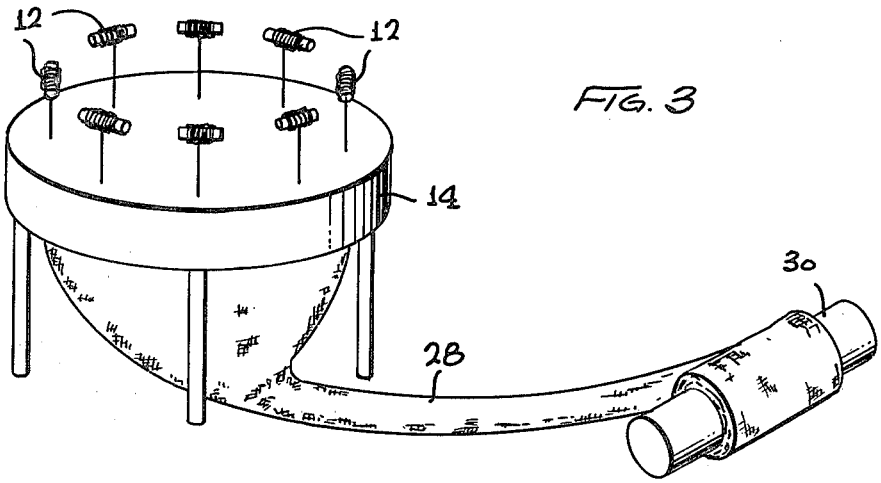
FIG. 3 is a simplified perspective view of apparatus used to form a plurality of precursor yarns into a knitted fabric in accordance with the method of FIG. 1.

FIG. 3 depicts an arrangement for forming the precursor yarns into a single bundle and knitting the bundle into a fabric, which arrangement includes the spools of yarn 12 and the knitting machine 14. The spools 12 are positioned above the knitting machine 14 such that the precursor yarn on each spool is unwound therefrom by being drawn downwardly into the top of the knitting machine 14. The knitting machine 14 which is of the circular type for knitting a jersey-style fabric forms the individual single ply precursor yarns into a bundle which is then knitted into the jersey-style fabric in the form of a continuous, hollow, cylindrical sock 28. The knitted sock 28 advances to the bottom of the knitting machine 14 from which it is collapsed flat and wound onto a roller 30. As so folded, the sock 28 forms a flat, double-ply, elongated fabric of generally uniform width and thickness which is advantageously used for processing in accordance with the invention.

Figure 4:
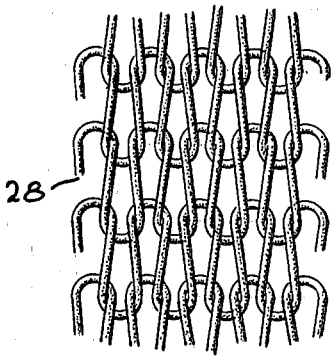
FIG. 4 is a plan view of a portion of a knit fabric formed by the apparatus of FIG. 3.

FIG. 4 depicts a portion of the jersey-style knitted sock 28. The knit design is itself a conventional one in which a single length of yarn forms a continuous series of loops that interlock with one another to form the assembled fabric. In the present example the single length of yarn comprises a loose bundle of the single ply precursor yarns supplied by the spools 12.

Figure 5:
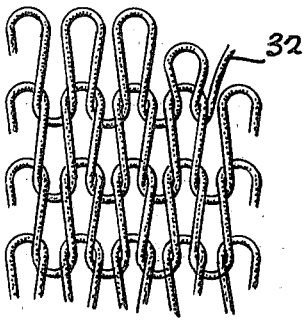
FIG. 5 is an enlarged plan view of a portion of the fabric of FIG. 4 illustrating the manner in which the fabric is easily deknitted.

While the precursor yarns can be formed into an elongated length of fabric using any one of a variety of different techniques such as weaving, knitting is preferred because of the ease and economy of formation and disassembly. Where weaving is used, for example, not only does fabric formation occur at a slower rate, but the fill yarns must usually be discarded upon disassembly. The advantages of knitting on disassembly of the fabric can be seen with reference to FIG. 5 which is a closeup view of the knitted sock 28 similar to that of FIG. 4 but illustrating the ease with which the knitted sock 28 is deknitted simply by pulling on an end 32 of the yarn bundle. The knitted sock 28 offers very little resistance to deknitting, enabling the sock 28 to be deknitted by feeding the end 32 of the yarn bundle into the next piece of apparatus in the process such as a twister in a single step. The knitting and deknitting of a tubular sock is shown and described herein for purposes of illustration only, and the knitting and deknitting of a flat, single ply fabric can just as easily be used.

The knitted sock 28, when folded flat, forms an elongated generally continuous fabric which readily lends itself to continuous processing at a relatively high rate of speed. Thus, the elongated fabric is easily and quickly drawn over, under and around rollers and similar apparatus so as to enable the movement of the yarns through cleaning baths and other processes at a high rate.

After formation of the knitted sock 28, and cleaning or other pre-carbonization processing as may be necessary, the sock 28 is wound several times around a skein and is then cut off. The cut knitted sock is then wound multiple times around another skein and is severed. This process which is repeated over and over again provides each skein with a desired quantity of the knitted sock. The skeins are then loaded into the carbonizing oven 18.

In lieu of skeining the knitted sock 28 for carbonization which may require little or no modification in existing carbonization equipment, the knitted sock 28 may be run on a generally continuous basis through a carbonization oven formed by modification of conventional equipment or by custom design of the oven to handle continuous material, with the advantage that the skeining step is eliminated and the material is carbonized at a higher rate.

Figure 6:
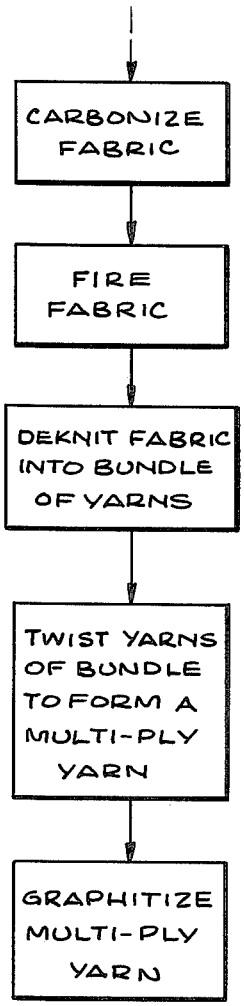
FIG. 6 is a block diagram of some of the successive steps in an alternative method of making carbon or graphite yarn according to the invention.

FIG. 6 depicts the last five successive steps in an alternate method of making carbon or graphite yarn according to the invention. The first four steps of the method of FIG. 6 are identical to those of FIG. 1. However, after carbonization of the fabric, firing of the yarns is accomplished while the yarns are still in fabric form. The fabric is then deknitted into a bundle of yarns which are in turn twisted to form the multi-ply yarn prior to graphitization. The method of FIG. 6 has the advantage that the yarns are fired while the fabric is still assembled, thereby greatly facilitating movement of the yarns through the firing furnace. At the same time the various loops of the yarn in the knitted fabric tend to remain as kinks in the yarns when deknitted, a desirable feature for some applications of the yarn such as for use as packing where a small amount of resiliency is often desirable.

Figure 7:
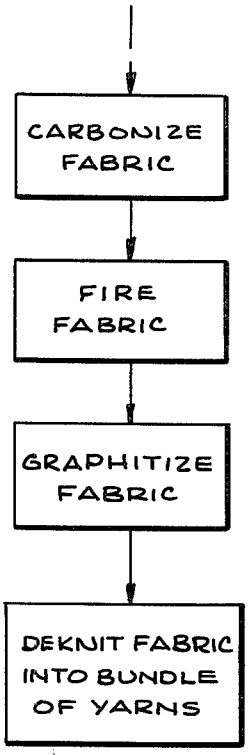
FIG. 7 is a block diagram of some of the successive steps in a further alternative method of making graphite yarn according to the invention.

In the further alternative embodiment of FIG. 7 the yarns are formed into a bundle, knit into a fabric, scoured and finally carbonized as in the case of the methods of FIGS. 1 and 6. The yarns are then fired while still in the knitted form as in the method of FIG. 6, and further are graphitized while still in fabric form prior to deknitting of the fabric into the yarn bundle. The method of FIG. 7 has the advantage that the yarns are both fired and graphitized while still in fabric form so as to make these steps very efficient. At the same time the kinks formed in the yarn are very pronounced and of an even more permanent nature than in the example of FIG. 6, making the resulting yarn highly suited for certain high resiliency applications such as pump packing.

EXAMPLE

The invention may be better understood by considering a specific example of making graphite cordage using the process of FIG. 1. In the example the precursor yarns were 1650 denier rayon. Ten spools of the single ply precursor yarn were mounted on a creel. The number of yarns is chosen in accordance with a number of factors including the volume of material that is desired to be knitted and processed.

The precursor yarns were drawn into a Leighton circular knitting machine. The knitting machine knits single end jersey-style fabric.

The knitted fabric was then fed into a continuous dry cleaning machine. The elongated fabric was started into the dry cleaning machine by being spliced to the trailing end of a starter fabric. Splicing was accomplished by inserting the trailing end of the fabric into the open leading end of the knitted tube and applying sealing tape on both sides of the fabric. The dry cleaning machine had a predetermined path for continuously moving yarns or other elongated material therethrough so as to continuously pull the elongated fabric through a drier, then a wash tank, and then another drier.

The fabric as cleaned by the dry cleaning machine was then wound onto skeins using a skein winder. The knitted fabric was wound around each skein multiple times to provide the wound skeins with a suitable thickness when loaded into the carbonizing oven.

Carbonization was then accomplished in an oven having an inert atmosphere and at the same time equipped with a system of hoses and tubes to allow exhaust fumes to escape. The temperature in the oven was gradually raised from 300° F. to 700° F.

Following carbonization the fabric was unwound from each skein and a loose end of the yarn bundle forming the knitted fabric was drawn from each of the opposite ends of the length of fabric into a twister. The twister comprised a 12-spindle twister. Since each yarn bundle is comprised of 10 single ply yarns, and since two of the yarn bundles are fed into the twister simultaneously, the twister forms a 20-ply twisted yarn in this example although other multiples of 10 could be used as desired. Each length of knitted fabric provides sufficient continuous lengths of the carbonized fabric bundles such that the twisted multi-ply yarn produced by the twister need only be knotted together on a very infrequent basis.

The twisted multi-ply yarn was next fed into a firing furnace. The firing furnace was maintained at a temperature in the 1600°–2800° F. range and an inert atmosphere was maintained therein. A residence time within the furnace for the twisted multi-ply yarn of less than a minute was used. Firing was found to raise the percentage of carbon in the twisted multi-ply yarn to about 90% in preparation for graphitization.

The fired yarn was next fed into the graphitization furnace in the form of an induction furnace. A graphitization temperature of 4000°–4500° F. at a residence time of less than a minute was used. The firing and graphitization furnaces were arranged in-line so that the two processes could be carried out in one operation.

When carbon yarn as opposed to graphite yarn is desired the yarn is rewound for ultimate use after it comes out of the firing furnace, thereby skipping the graphitization furnace. The following is a comparative table of the physical properties of carbon and graphite 20 ply yarn made in accordance with the above example:

| Property | Graphite Yarn | Carbon Yarn |
|---|---|---|
| Yield (yds/lb) | 372 | 317 |
| Yarn diameter (in.) | 0.075 | 0.078 |
| Breaking strength (lbs.) | 26 | 29 |
| Density (g/cc) | 1.42 | 1.50 |
| Carbon assay (percent) | 98.6 | 90.0 |
| Ash content (percent) | nil | 0.46 |
| Twist (tpi) | 2 | 2 |

The detailed process described above was repeated with the exception that the yarn was formed from 10 plies instead of 20 and the process of FIG. 6 was followed instead of that of FIG. 1 such that the knitted fabric was not deknit until after the firing step. In addition, the residence time in the graphitization furnace was varied to see what the effect would be. The following results were produced:

| | Sample 1 | Sample 2 |
|---|---|---|
| Breaking Strength (lbs.) | 10.9 | 5.9 |
| Specific Gravity | 1.380 | 1.394 |
| Carbon Assay (percent) | 97.6 | 99.6 |
| Yield (yds/lb) | 767 | 773 |

Following the firing step and prior to deknitting the material was observed to have relatively sharp bends in the loops thereof. Because of a relatively high modulus of the fired material and the tight loops, the material was relatively rough and therefore somewhat difficult to deknit compared to material made by the process of FIG. 1.

A further batch of graphite yarn was made in accordance with the detailed process described above except that the method of FIG. 7 was used instead of that of FIG. 1. This method was found to produce yarn which is relatively strong and yet which is comprised of single ply yarns which are texturized, apparently due to firing and particularly graphitization while in knitted form. The kinks were found to have a high memory; however, the yarn can be kept relatively straight and handled reasonably well as long as enough tension is applied on it in the process.

What is claimed is:

1. A method of making yarn which has been at least partially carbonized from a precursor yarn comprising the steps of:
   - forming the precursor yarn into a length of fabric;
   - taking the length of fabric through a carbonization process to convert the precursor yarn into a yarn of at least partly carbon composition; and
   - thereafter disassembling the fabric into the yarn which has been at least partially carbonized;
   - the yarn being comprised of a plurality of single ply yarns which are twisted together to form a multi-ply yarn as a separate step at some point in the method.

2. The invention set forth in claim 1, further comprising the step of taking the length of fabric through a pretreating process to enhance carbonization prior to taking the length of fabric through a carbonization process.

3. The invention set forth in claim 1, wherein the step of forming the precursor yarn into a length of fabric comprises knitting the yarn into a knitted length of fabric, and the step of disassembling the fabric into the yarn comprises pulling an end of the yarn from the knitted length of fabric to deknit the length of fabric.

4. The invention set forth in claim 1, wherein following disassembly of the fabric into the yarn which has been at least partially carbonized the yarn is taken through a firing process to substantially raise the percentage of carbon in the yarn.

5. The invention set forth in claim 4, wherein following the taking of the yarn through the firing process the yarn is at least partially graphitized.

6. A method of making yarn which has been at least partially carbonized from a plurality of precursor yarns comprising the steps of:
   - forming the plurality of precursor yarns into a single bundle;
   - knitting the single bundle into an elongated fabric;
   - subjecting the fabric to pre-carbonization treatment as desired;
   - periodically winding the fabric around a different one of a plurality of skeins and severing the fabrics;
   - taking the skeins of fabric through a carbonization process;
   - unwinding the fabric from the skeins;
   - deknitting the fabric into a bundle of yarns; and
   - twisting the precursor yarns of the bundle to form a multi-ply yarn at some point in the method.

7. The invention set forth in claim 6, wherein the step of subjecting the fabric to pre-carbonization treatment includes the steps of providing a dry cleaning machine having a path therethrough for yarn to be cleaned and continuously driving the elongated fabric in the direction of elongation of the fabric along the path through the dry cleaning machine.

8. The invention set forth in claim 6, comprising the further steps of taking the multi-ply yarn through a firing process, and thereafter taking the multi-ply yarn through a graphitization process.

9. A method of processing a plurality of single ply, carbonizable yarns comprising the steps of:
   - providing each of the single ply yarns on a different one of a plurality of spools;
   - providing a circular knitting machine;
   - simultaneously drawing each of the plurality of single ply yarns from its spool into the circular knitting machine to form a single bundle of yarns;
   - continuously knitting a tubular fabric from the single bundle of yarns;
   - collapsing the tubular fabric flat;
   - cleaning the collapsed tubular fabric;
   - at least partially carbonizing the collapsed tubular fabric;
   - deknitting the tubular fabric to provide a bundle of cleaned and carbonized yarns; and
   - twisting the single ply yarns forming the single bundle to form a multi-ply yarn at some point in the method.

10. The invention set forth in claim 9, wherein the collapsed tubular fabric is repetitively severed into a plurality of lengths prior to the at least partial carbonization thereof and the step of deknitting the tubular fabric includes the starting of a loose yarn bundle from each of the opposite ends of each of the lengths of the folded tubular fabric.

* * * * *